US007728704B2

(12) United States Patent
Schmidt et al.

(10) Patent No.: US 7,728,704 B2
(45) Date of Patent: Jun. 1, 2010

(54) METHOD FOR REDUCING CONTINUOUS CHARGE

(75) Inventors: Stephen M. Schmidt, Menomonee Falls, WI (US); Paul D. Lindsay, Cedarburg, WI (US); Dennis A. Maller, Racine, WI (US)

(73) Assignee: Trombetta, LLC, Menomonee Falls, WI (US)

( * ) Notice: Subject to any disclaimer, the term of this patent is extended or adjusted under 35 U.S.C. 154(b) by 308 days.

(21) Appl. No.: 11/810,927

(22) Filed: Jun. 7, 2007

(65) Prior Publication Data

US 2008/0303617 A1 Dec. 11, 2008

(51) Int. Cl.
*H01H 67/02* (2006.01)
*H01R 4/36* (2006.01)

(52) U.S. Cl. ..... 335/126; 335/131; 439/810

(58) Field of Classification Search ..... 335/126, 335/131, 127; 439/810–814
See application file for complete search history.

(56) References Cited

U.S. PATENT DOCUMENTS

| | | | | |
|---|---|---|---|---|
| 2,152,124 | A | 3/1939 | Winkler | |
| 2,206,306 | A | 7/1940 | Sager | |
| 2,290,768 | A | 7/1942 | Sager | |
| 3,334,319 | A | 8/1967 | Herrmann et al. | |
| 3,654,538 | A | 4/1972 | Gardberg | |
| 4,149,131 | A | 4/1979 | Kawamura et al. | |
| 4,378,542 | A | 3/1983 | Feil | |
| 4,604,597 | A | 8/1986 | Bogner et al. | |
| 4,692,835 | A * | 9/1987 | Setoguti et al. | 361/104 |
| 4,703,294 | A | 10/1987 | Yokoyama et al. | |
| 4,740,769 | A | 4/1988 | Mitschik | |
| 4,769,295 | A | 9/1988 | Kudo et al. | |
| 4,801,909 | A | 1/1989 | Fasola | |
| 4,847,580 | A | 7/1989 | Morishita et al. | |
| 4,978,935 | A | 12/1990 | Hoffman et al. | |
| 4,983,941 | A | 1/1991 | Tanaka | |
| 5,003,206 | A | 3/1991 | Burson | |
| 5,021,760 | A | 6/1991 | Krubsack et al. | |
| 5,132,653 | A * | 7/1992 | Nakatake et al. | 335/202 |
| 5,160,910 | A | 11/1992 | Tsuji | |
| 5,521,566 | A | 5/1996 | Krubsack et al. | |

(Continued)

OTHER PUBLICATIONS

Photograph of existing terminal cover. Date: unknown, Source: unknown.

*Primary Examiner*—Elvin G Enad
*Assistant Examiner*—Bernard Rojas
(74) *Attorney, Agent, or Firm*—Ryan Kromholz & Manion, S.C.

(57) ABSTRACT

Provided is a device mounted contactor and a method of reducing continuous charge distribution, especially in a vehicle. The contactor includes a housing, and a plurality of power terminals. The device may further include a conductance shield and support structure extending from the housing. Situated at least partially in the housing is a switch, which is capable of electrically coupling at least two of the plurality of power terminals. One or more electrically insulative covers may be provided. The contactor may also provide a fused accessory terminal, which is electrically coupled to one of the power terminals through a fuse. A method according to the present invention reduces continuous electrical charge distribution in an electrical circuit by mechanically attaching a first contactor power terminal to a battery terminal and electrically coupling a second contactor power terminal to a circuit, which may include a vehicle starter.

2 Claims, 5 Drawing Sheets

U.S. PATENT DOCUMENTS 5,568,113 A 10/1996 Chen
5,643,693 A 7/1997 Hill et al.
5,694,100 A 12/1997 Jacquet et al.
5,812,041 A * 9/1998 Ishikawa et al. ..... 335/126
5,831,804 A 11/1998 Vilou
6,028,381 A * 2/2000 Yumiyama et al. ..... 310/68 C
6,040,751 A 3/2000 Haehnel et al.
6,229,415 B1 5/2001 Quentric
6,229,416 B1 5/2001 Ebihara et al.
6,310,529 B1 10/2001 Luetzow et al.
6,380,831 B1 * 4/2002 Kajino ..... 335/127
6,411,184 B1 6/2002 Comtois et al.
6,424,511 B1 7/2002 Levinas
6,693,503 B1 2/2004 Nguyen et al.
6,762,663 B2 7/2004 Andoh et al.
6,930,576 B2 8/2005 Usami
6,943,655 B1 9/2005 McMahon et al.
6,967,549 B2 11/2005 Zhou et al.
7,038,563 B2 5/2006 Andoh et al.
7,545,248 B2 * 6/2009 Imanishi et al. ..... 335/202
2005/0190024 A1 * 9/2005 McMahon et al. ..... 335/126

* cited by examiner

METHOD FOR REDUCING CONTINUOUS CHARGE

BACKGROUND OF THE INVENTION

The present invention relates generally to switches and electrical charge distribution, and more specifically to a method and device for reducing continuous electric charge distribution in a vehicle.

Normally, in a vehicle motorized by an internal combustion engine, a battery is used to provide operating power for starting the engine, for igniting fuel in the cylinders and for running vehicle accessories such as lighting, information systems and entertainment systems. While these duties have different electrical current requirements, the amperage required for starting the engine far exceeds the amperage required for maintaining the other functions.

The starting circuit of a vehicle generally includes a battery, a starter contactor and a starter, wired in series. The starter contactor has two contactor terminals and is usually mounted between the battery and the starter. A wire is coupled at one end to the positive battery terminal and at the other end to a first starter contactor terminal. The second starter contactor terminal is then wired to the starter. When the ignition key of the vehicle is turned, the starter contactor is closed, thereby electrically coupling the contactor terminals and supplying the starter with the required starting amperage. Due to the high required amperage, the wire coupling the positive battery terminal to the starter contactor is of substantial diameter; therefore, it is costly.

Furthermore, a battery and a starter contactor of a vehicle are usually not juxtaposed. The greater the separation between the battery and the starter contactor, the greater the continuous charge distribution within the vehicle. That is, as the amount of wire required to couple the positive battery terminal to the starter contactor increases, the distribution of positive charge within the vehicle increases. An increase in the distribution of positive charge within the vehicle can be problematic in accident situations, potentially increasing the risk of fire. Further, such an increase requires multiple protective covers, one at the battery and one at the contactor, for guarding against incidental contact with the continuously live terminals during routine maintenance in close proximity thereto. Regarding the latter point, not only does the positive battery terminal require a protective cover, but a protective cover should be used to shield against incidental contact with the continuously live terminal on the starter contactor.

Contactors for use in circuits demanding delivery of high amperage are generally known. For example, U.S. Pat. No. 5,521,566, which is assigned to the owner of the incident application, discloses a solenoid unit for use in high amperage environments. U.S. Pat. No. 5,521,566 is incorporated by reference in its entirety.

Despite the existence and knowledge of such devices, the art of vehicle electrical circuit switching would benefit from a method and device for eliminating costly manufacturing components and increasing the safety of the electrical distribution system in general.

SUMMARY OF THE INVENTION

The present invention provides a device and method for eliminating costly components and installation labor and increasing the safety of an electrical distribution system in general. The device is a contactor including a housing, which may include a switch housing having a flange coupled to an end plate, and a plurality of power terminals. Some of the plurality of power terminals may be formed into threaded posts and secured to the housing by way of a threaded nut. A gasket may be provided at the abutment of the switch housing to the end plate. The device may further include a conductance shield portion that extends from the housing. A support structure may also depend from the housing, and may include a plurality of support fins and a fin stabilizer.

Situated at least partially in the housing is a switch, which is capable of electrically coupling at least two of the plurality of power terminals. The switch may be operable upon the receipt of a control signal. In addition, a first electrically insulative cover is provided, which is selectively engageable with the housing to at least partially surround one of the power terminals. Additional insulative covers may be provided to at least partially surround others of the plurality of power terminals.

In addition to providing a switching function, a device according to the present invention may provide a fused accessory terminal, which is electrically coupled to one of the power terminals through a fuse.

The present invention further contemplates, in combination with a battery having a plurality of conductive battery terminals, a device having a housing with an internal cavity and a switch contained at least partially in the housing. Further, a first power terminal extends from the internal cavity through the housing and is mateable with one of the conductive battery terminals. A second power terminal extends from the internal cavity through said housing. The switch is capable of electrically conductively coupling the first power terminal to the second power terminal.

A method according to the present invention is directed to reducing continuous electrical charge distribution in an electrical circuit. Continuous electrical charge distribution can be reduced by providing a contactor having two power terminals and a switch. The switch is adapted to establish electrical conductivity between the power terminals in a first mode and to break electrical conductivity between the power terminals in a second mode. One of said power terminals is mechanically attached directly to a battery terminal on the battery thereby forming an electrically conductive connection between the two, the other power terminal is electrically coupled, e.g. by way of an electrical wire, to a circuit, which may include a starter.

Another method according to the present invention may reduce continuous charge distribution in a vehicle having a battery and a starter. The method includes the steps of providing a contactor having a first contactor terminal mateable with a battery terminal on the battery and further having second contactor terminal. The first contactor terminal is mated to the terminal on the battery, and the second contactor is electrically coupled to the starter.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
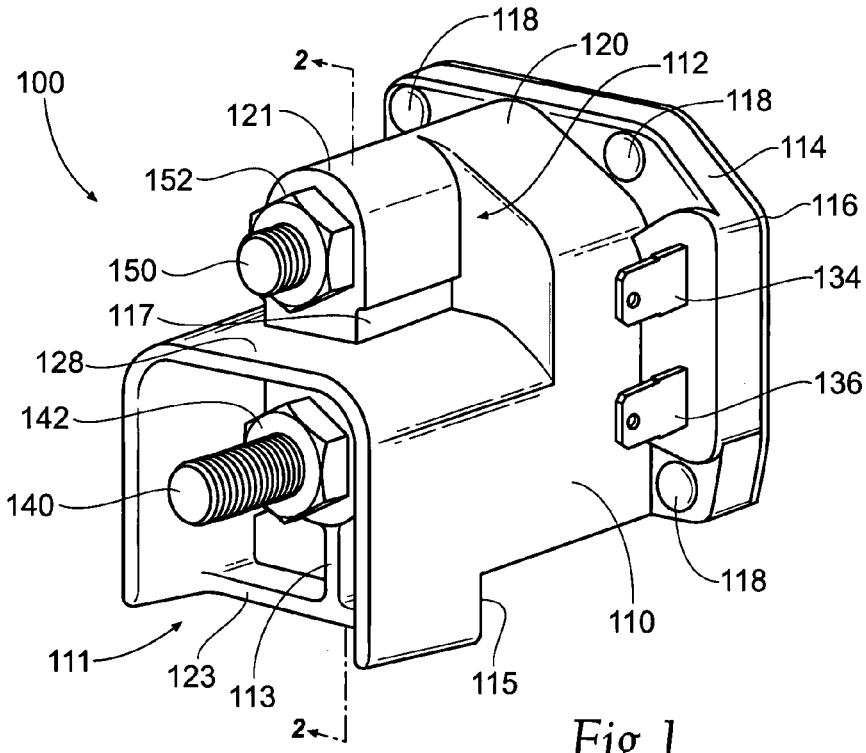
FIG. 1 is a perspective view of an embodiment of a device mounted contactor according to the present invention.
Figure 2:
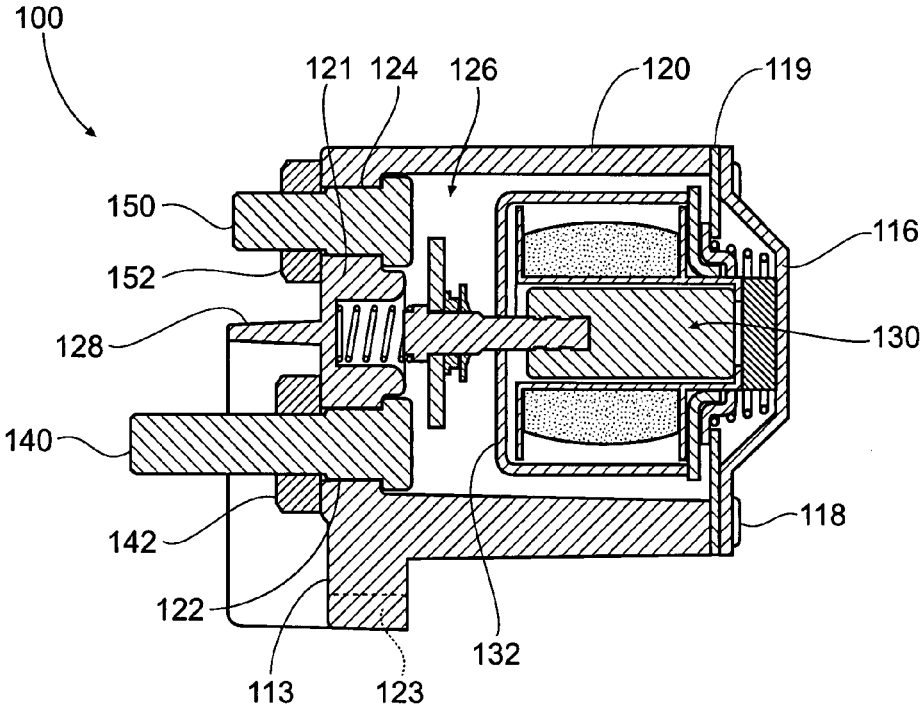
FIG. 2 is a side elevation cross-section view taken along line 2-2 of FIG. 1.

Turning now to the figures, FIG. 1 and FIG. 2 depict an embodiment 100 of a device mounted contactor according to the present invention. Generally, the contactor 100 includes a contactor housing 110, a switch 130 (see FIG. 2), a first power terminal 140 and a second power terminal 150.

While the contactor housing 110 may be formed of a single unitary member, the housing 110 preferably comprises a switch housing 112 having a flange 114 coupled to an end plate 116 by way of a plurality of fasteners 118, such as rivets. Disposed between the switch housing 112 and the end plate 116, there may be a desired gasket 119 formed of a material such as cork. The end plate 116 may be formed from zinc plated steel. The switch housing 112 preferably comprises an electrically nonconductive structure including a base 120 and a terminal block 121, the terminal block 121 including a first terminal aperture 122 and a second terminal aperture 124. The base 120 includes an internal cavity 126. The terminal block 121 generally surrounds the first and second power terminals 140,150 and extends from the base 120. A conductance shield 128 is preferably provided extending from the terminal block 121 intermediate the power terminals 140,150 substantially the same distance as the second power terminal 150.

Furthermore, contactor support structure 111 may be disposed on or formed integrally with the housing 110. As will be described in further detail later, the support structure 111 functions to relieve torsional stress on a battery terminal if a downward force is applied to the housing 110, especially proximate the end plate 116, when the contactor 100 is coupled directly to the battery terminal. A suitable support structure 111 comprises at least one fin 113 and a fin stabilizer 123. As shown, the support fin 113 depends generally from the terminal block 121.

Figure 3:
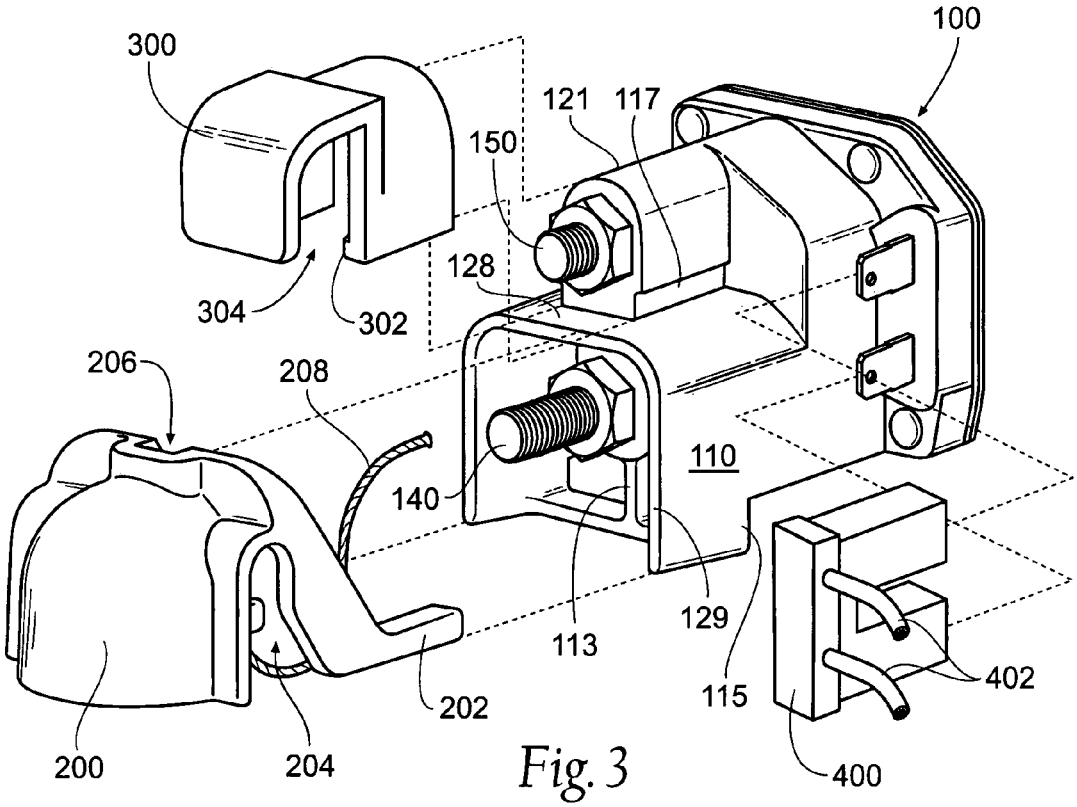
FIG. 3 is a partially exploded perspective view of the embodiment of FIG. 1, further depicting embodiments of terminal covers and a controller connector.
Figure 4:
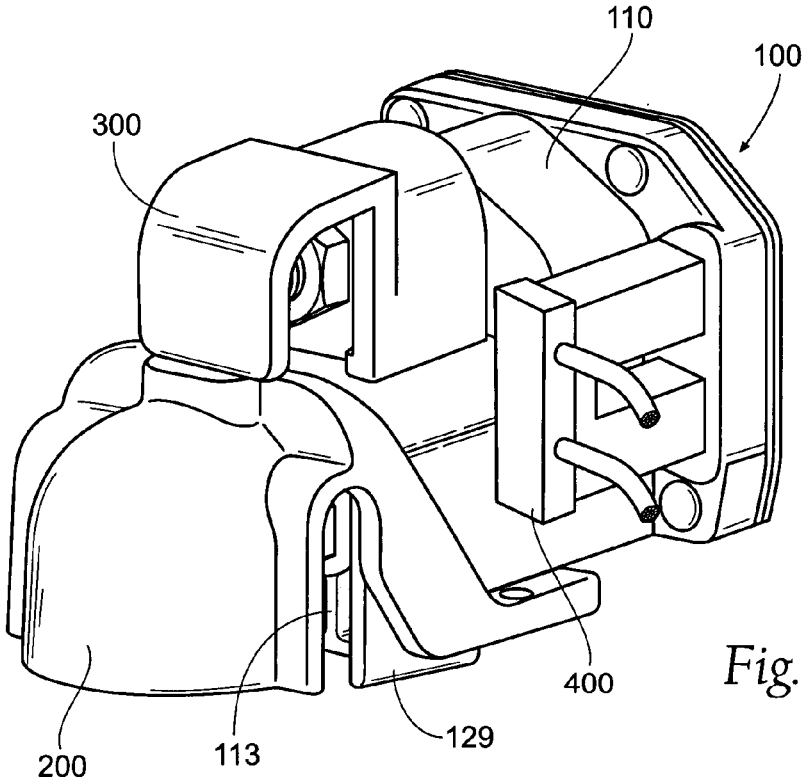
FIG. 4 is a perspective view of the embodiment of FIG. 3.
Figure 5:
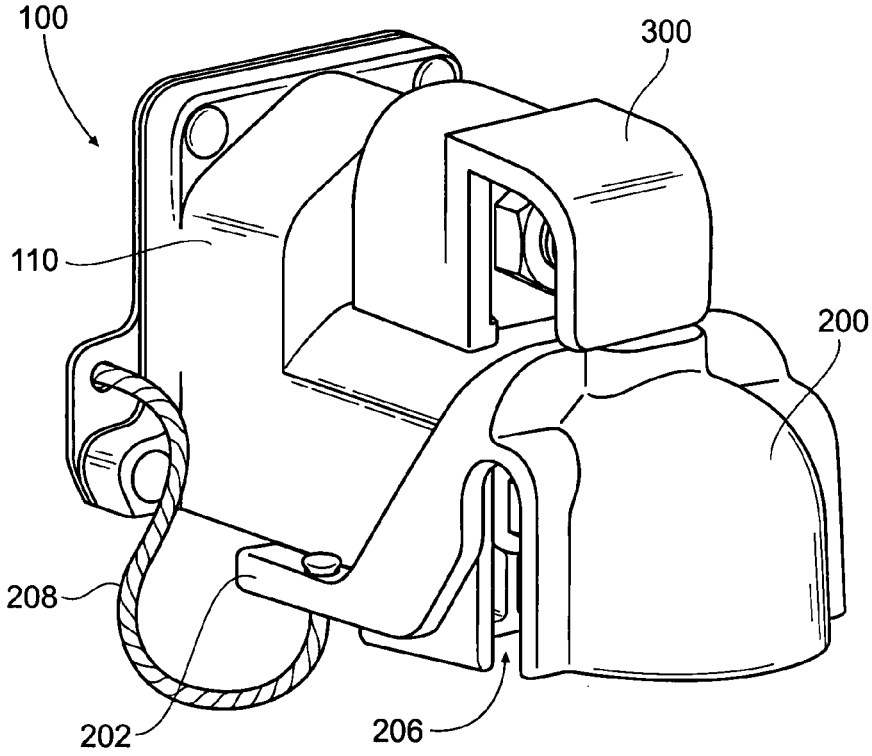
FIG. 5 is a perspective view of the embodiment of FIG. 3.
Figure 6:
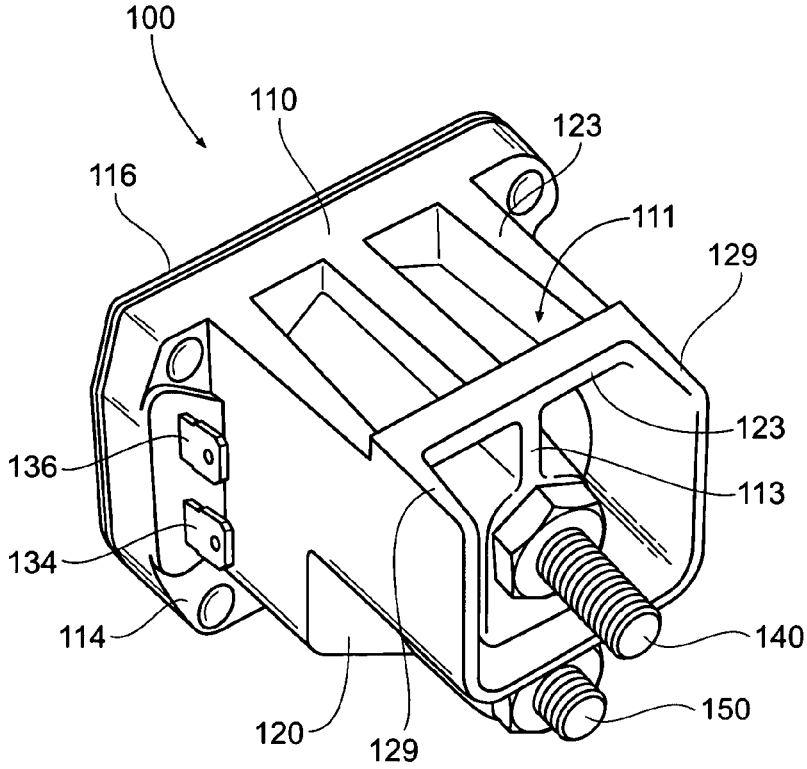
FIG. 6 is a perspective view of the embodiment of FIG. 1.

With reference also to FIG. 3, the housing 110 may further include structure that cooperates with supporting structure on terminal covers. For example, in the depicted embodiment 100, the outer support fin 113 depending from the conductance shield 128 includes a rear catch edge 115 for engaging retaining arms 202 of a first terminal cover 200. Furthermore, the terminal block 121 may include terminal cover slots 117 slidably engageable with terminal cover retaining ledges 302 disposed on a second terminal cover 300. Alternatively, terminal cover 300 may attach to terminal block 121 with a snap-fit configuration.

The switch 130 is used to couple or decouple the first power terminal 140 to or from the second power terminal 150, respectively. The switch 130, which may be an electromagnetic switch 132, is at least partially disposed in the internal cavity 126 of the switch housing 112. The switch 130 may be activated from a remote location. To that end, control access to the switch 130 must be provided through the housing 110. Where direct electrical connection is desired for control, connector terminals may be provided, such as first and second blade terminals 134,136. In the preferred embodiment 100, the electromagnetic switch 132 contained in the housing 110 is of known construction, similar to that disclosed in U.S. Pat. No. 5,521,566.

The power terminals 140,150 extend through the housing 110 by way of the terminal block apertures 122,124, and into, or are accessible from, the internal cavity 126. The first power terminal 140 is held stationary relative to the housing 110 preferably by way of a first threaded nut 142. The second power terminal 150 is held stationary relative to the housing 110 by way of a second threaded nut 152.

The embodiment of FIG. 1 may be provided with terminal covers, as shown in FIGS. 3-6, inclusive. A first terminal cover 200 is provided, which is adapted to be selectively engageable with the housing 110 near the first power terminal 140. The first terminal cover 200 includes retaining arms 202, which are adapted to engage the rear catch edges 115 of the outer support fin 113. In addition, the cover 200 includes a surface (not shown) that is mateable with the shield edge 129. To allow access to the first power terminal 140 through the terminal cover 200, the cover 200 may be supplied with at least one cable slot 204. The cover 200 may be formed with two cable slots 204, thereby enabling access to the first power terminal 140 from either side of the cover 200. The first terminal cover 200 may also be provided with a placement notch 206 on a side of the cover 200 that faces the second power terminal 150. The placement notch 206 simplifies engagement of the cover 200 with the housing 110 by providing increased clearance around the second power terminal 150 during installation. Further, a tether 208 may be provided to retain the cover 200 proximate the contactor 100 after the cover 200 has been removed from the housing 110. For instance, the tether 208 may be a nylon cord coupled to the end plate 116.

A second terminal cover 300 may be provided, which is adapted to be selectively engageable with the housing 110 near the second power terminal 150. The second terminal cover 300 includes retaining ledges 302, which are adapted to engage the terminal cover slots 117 of the terminal block. To allow access to the second power terminal 150 through the terminal cover 300, the cover 300 may be supplied with at least one cable slot 304. The cover 300 may be formed with two cable slots 304, thereby enabling access to the second power terminal 150 from either side of the cover 300.

Also shown in FIGS. 3-6, inclusive, is an electrical connector 400, which couples a pair of electrical wires 402 to the blade connector terminals 134 and 136. Alternative means of switch control may also be employed, which do not require physical electrical connection through the housing 110. For instance, the switch may be controlled by wireless communication control signals.

A device according to the description heretofore supplied is preferably used to reduce continuous charge distribution in a vehicle. In existing or newly manufactured vehicles, an embodiment of the device mounted contactor may be used to replace not only prior starter contactors, but also the heavy duty wiring that is usually installed between the battery and the starter contactor. Thus, a method for reducing continuous charge distribution in a vehicle involves providing a contactor having two power terminals. One contactor power terminal is coupled to a terminal of a vehicle battery and the second power terminal is electrically coupled to an electric circuit requiring only intermittent voltage.

Figure 7:
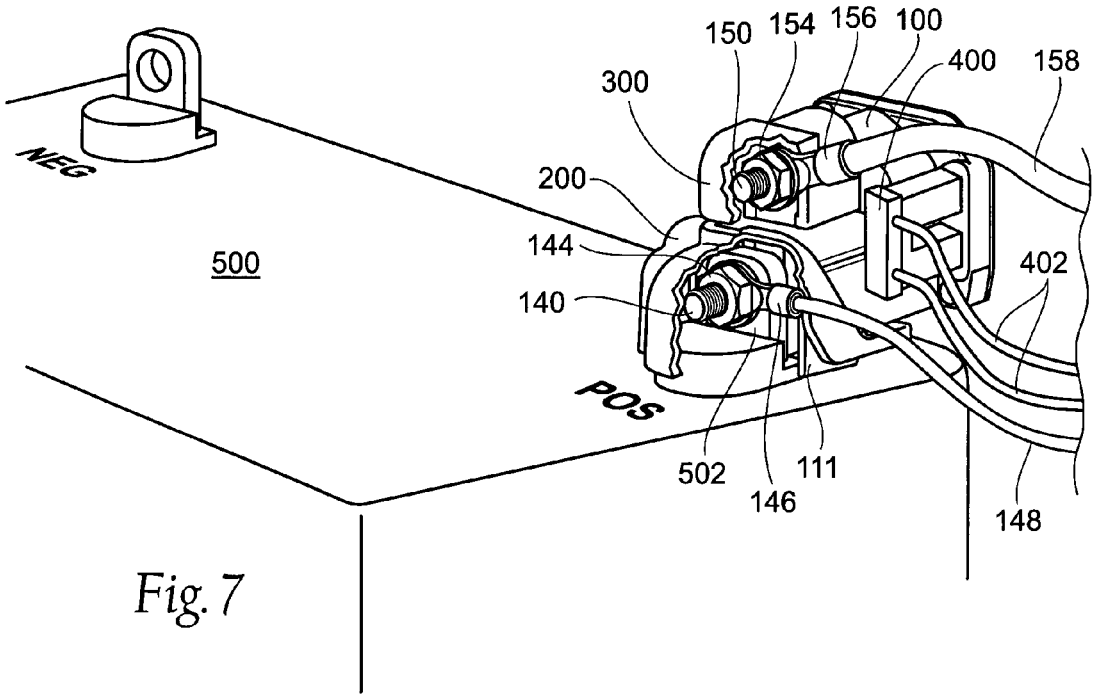
FIG. 7 is a perspective view of the embodiment of FIG. 3 coupled to a battery.
Figure 8:
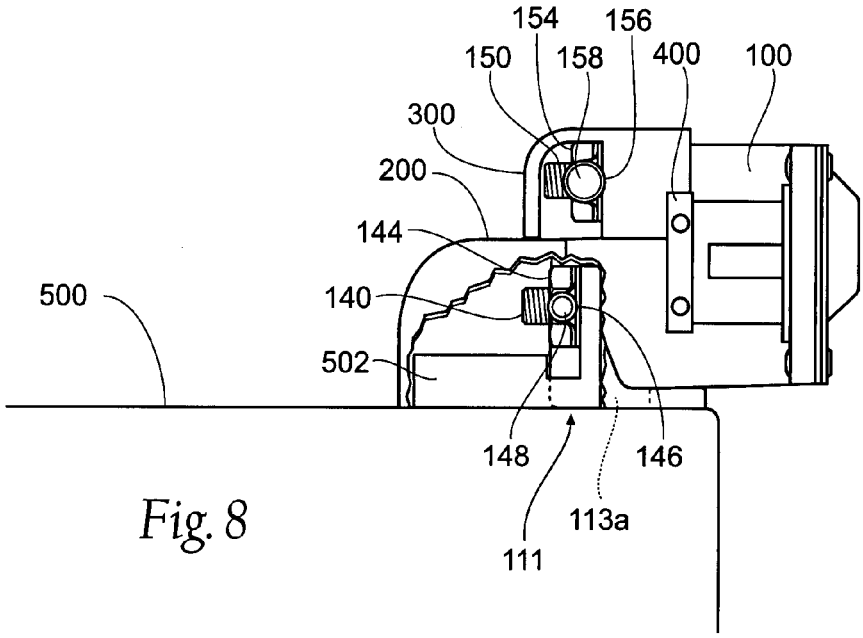
FIG. 8 is a side elevation view of the embodiment of FIG. 3 coupled to a battery.

FIG. 7 and FIG. 8 depict the first embodiment 100 coupled to a vehicle battery 500 for use in switching the power therefrom. While the first power terminal 140 is shown directly coupled to the positive battery terminal 502, it will be readily apparent to one of ordinary skill in the art that the contactor 100 is not limited to such an arrangement. Among other arrangements, either power terminal 140 or 150 could be coupled to any battery terminal. In the depicted arrangement, the first power terminal 140 is a threaded stud. A first mounting nut 144 is provided and threaded onto the first power terminal 140 after the terminal 140 was inserted into an aperture on the battery terminal 502. Once the nut 144 is tightened, the contactor 100 is physically supported by the junction, including the first power terminal 140, the battery terminal 502 and the nut 144, and also supported by the contactor support structure 111 which may rest against or near a surface of the battery 500. In addition to the nut 144 mechanically coupling only the first power terminal 140 to the battery terminal 502, the nut 144 may further maintain an accessory connector 146 in electrical contact with the battery terminal 502. An accessory tap wire 148, electrically coupled to the accessory connector 146 may then supply power to desired circuitry, such as a fuse block (not shown) for power distribution. An optional tab or number of tabs (not shown) may be provided extending from the edge of the conductance shield 129 to prevent rotation of the connector 146 during installation as well as improper loading resulting from the connector 146 exerting an undesirable force on the battery terminal 502 or other parts of the battery 500.

The second power terminal 150 is preferably electrically coupled to a switched circuit by way of a circuit wire 158 and an electrical connector 156. The electrical connector 156 is kept in contact with the second power terminal 150 by using a second mounting nut 154. Also, switch control is achieved in this embodiment by way of switch control wires 402 being electrically coupled to the switch 130 by way of the connector 400 and the blade terminals 134,136.

After the contactor 100 is arranged in the described manner, when the switch 130 is caused to activate, thereby electrically coupling the first power terminal 140 to the second power terminal 150, the circuit wire 158 will be brought to an electrical potential substantially equal, if not the same, as the battery terminal 502. Thus, when the switch 130 activates, the circuit (not shown) supplied by the circuit wire 158 is supplied with battery voltage. For example, if the circuit wire 158 is electrically coupled to a starter on a vehicle, when the switch 130 is activated, the circuit wire 158 offers battery potential to the starter, which, in turn, draws current from the battery 500.

Figure 9:
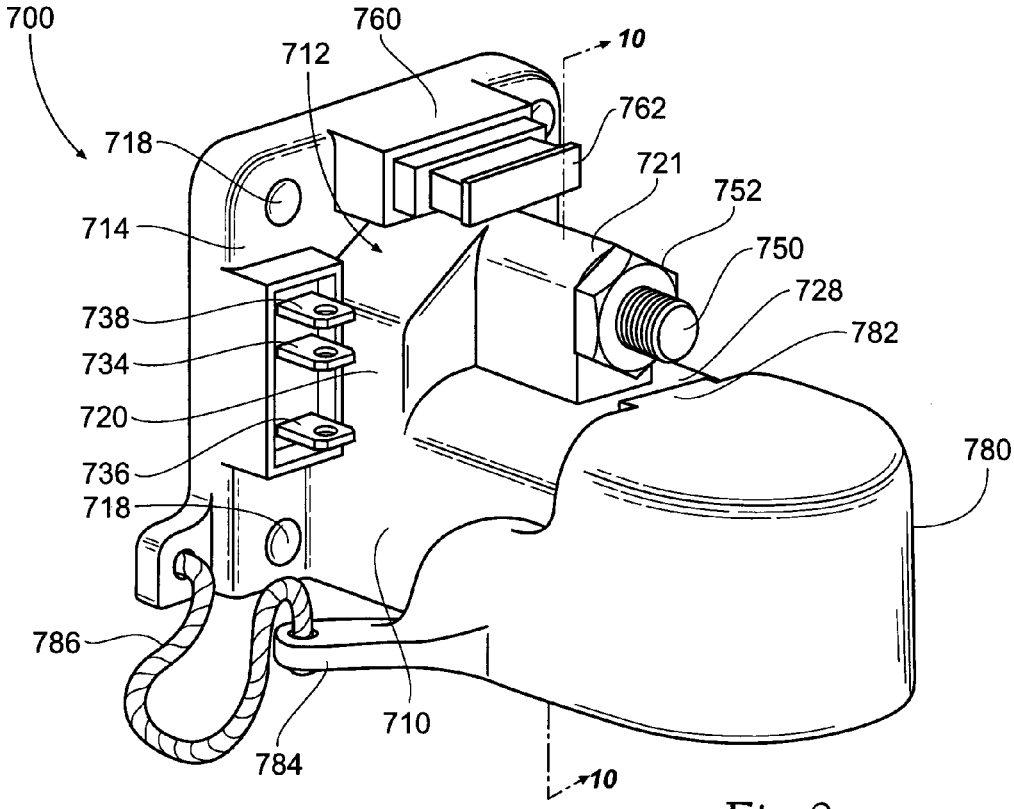
FIG. 9 is a perspective view of an alternate embodiment of a device mounted contactor according to the present invention.
Figure 10:
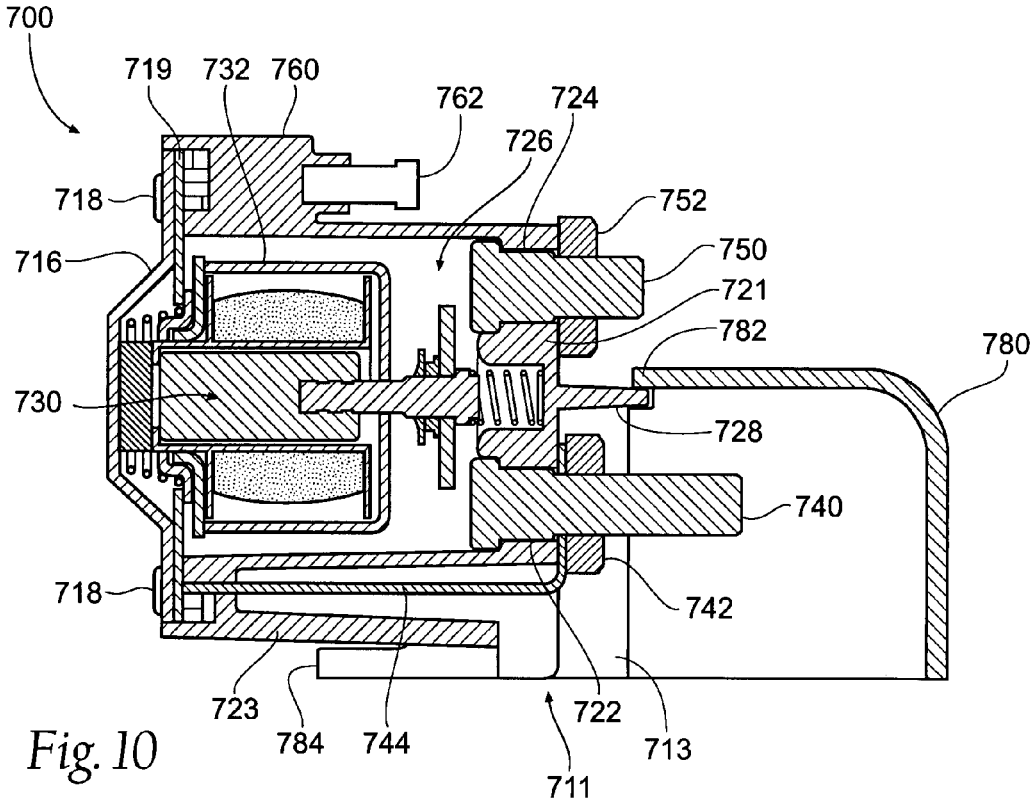
FIG. 10 is a side elevation cross-section view taken along line 10-10 of FIG. 9.

An alternate embodiment 700 of a device mounted contactor is depicted in FIG. 9 and FIG. 10. The general construction and operation of this embodiment 700 is preferably similar to the prior embodiment 100. That is, generally, the contactor 700 includes a contactor housing 710, a switch 730, a first power terminal 740 and a second power terminal 750.

While the contactor housing 710 may be formed of a single unitary member, the housing 710 preferably comprises a switch housing 712 having a flange 714 coupled to an end plate 716 by way of a plurality of fasteners 718, such as rivets. Disposed between the switch housing 712 and the end plate 716, there may be a desired gasket 719 formed of a material such as cork. The end plate 716 may be formed from zinc plated steel. The switch housing 712 preferably comprises an electrically nonconductive structure including a base 720 and a terminal block 721, the terminal block 721 including a first terminal aperture 722 and a second terminal aperture 724. The base 720 includes an internal cavity 726. The terminal block 721 generally surrounds the first and second power terminals 740,750 and extends from the base 720. A conductance shield 728 is preferably provided extending from the terminal block 721 intermediate the power terminals 740,750 substantially the same distance as the second power terminal 750.

Furthermore, contactor support structure 711 may be disposed on or formed integrally with the housing 710. As will be described in further detail later, the support structure 711 functions to relieve torsional stress on a battery terminal if a downward force is applied to the housing 710, especially proximate the end plate 716, when the contactor 700 is coupled directly to the battery terminal. A suitable support structure 711 comprises a plurality of support fins 713 and a fin stabilizer 723. As shown, the support fins 713 depend generally from the terminal block 721. In a preferred embodiment, two outer support fins 713 extend towards the base 720 of the switch housing 712 from the conductance shield 728.

The housing 710 may further include structure that cooperates with supporting structure on terminal covers. For example, in the depicted embodiment 700, the outer support fins 713 depending from the conductance shield 728 each include a rear catch edge (not shown) for engaging retaining arms 784 of a first terminal cover 780.

The switch 730 is used to couple or decouple the first power terminal 740 to or from the second power terminal 750, respectively. The switch 730, which may be an electromagnetic switch 732, is at least partially disposed in the internal cavity 726 of the switch housing 712. The switch 730 may be activated from a remote location. To that end, control access to the switch 730 must be provided through the housing 710. Where direct electrical connection is desired for control, connector terminals may be provided, such as first and second blade terminals 734,736. In the preferred embodiment 700, the electromagnetic switch 732 contained in the housing 710 is of known construction, similar to that disclosed in U.S. Pat. No. 5,521,566.

The power terminals 740,750 extend through the housing 710 by way of the terminal block apertures 722,724, and into, or are accessible from, the internal cavity 726. The first power terminal 740 is held stationary relative to the housing 710 preferably by way of a first threaded nut 742. The second power terminal 750 is held stationary relative to the housing 710 by way of a second threaded nut 752.

The embodiment of FIG. 9 is shown provided with a terminal cover 780. The terminal cover 780 is adapted to be selectively engageable with the housing 710 near the first power terminal 740. The cover 780 includes retaining arms 784, which are adapted to engage the rear catch edges of the outer support fins 713. In addition, the cover 780 includes a surface 782 that is generally mateable with the conductance shield 728. Further, a tether 786 may be provided to retain the cover 780 proximate the contactor 700 after the cover 700 has been removed from the housing 710. For instance, the tether 786 may be a nylon cord coupled to the housing 710.

In addition to providing the switching operation, this embodiment 700 provides a fused accessory connection. A fuse receptacle 760 is formed in the housing 710 into which a fuse 762 may be received. When placed in the receptacle 760, one terminal of the fuse 762 is coupled to the power terminal 740 by way of an electrical conductor, which may include a strap conductor, and the other terminal of the fuse 762 is coupled to a connection point, such/as a fused blade terminal 738 extending from the housing 710. In this way, a fused accessory output is provided to run vehicle accessories. The terminal cover 780 of this embodiment 700, like the first terminal cover 200 which included an access slot 204, may also be provided with a similar slot (not shown). Alternatively, either slot may replaced with a "knock-out" type opening having a frangible periphery for easy removal when desired.

The latter embodiment 700 may be used in a fashion similar to that of the first 100.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A method of reducing continuous charge distribution in a vehicle having a battery and a starter, the method comprising:

providing a contactor having two power terminals and a switch, said switch adapted to establish electrical conductivity between said power terminals in a first mode and to break electrical conductivity between said power terminals in a second mode, mechanically attaching one of said power terminals directly to a battery terminal on said battery thereby forming an electrically conductive connection between said battery terminal and said one of said power terminals, and electrically coupling the other of said power terminals to said starter.

2. A method according to claim 1, wherein said step of electrically coupling the other of said power terminals to said starter comprises connecting one end of a two-ended electrical wire to said other of said power terminals and connecting the other end of said two-ended electrical wire to said starter.

* * * * *